United States Patent [19]

DeLeo

[11] Patent Number: 4,822,289

[45] Date of Patent: Apr. 18, 1989

[54] EASILY REMOVABLE HIGH VOLTAGE GROUND STUD INSULATOR

[76] Inventor: John DeLeo, 107 Sun Valley Dr., Southington, Conn. 06489

[21] Appl. No.: 104,800

[22] Filed: Oct. 2, 1987

[51] Int. Cl.[4] ..... H01R 4/66

[52] U.S. Cl. ..... 439/92; 439/904; 439/934; 174/138 F; 361/341

[58] Field of Search ..... 439/92, 94, 135, 136, 439/367, 521, 625, 725, 750, 892, 904, 933, 934; 174/5 R, 5 SG, 138 F; 361/341

[56] References Cited

U.S. PATENT DOCUMENTS 4,744,765 5/1988 DeLeo ..... 439/92

*Primary Examiner*—Eugene R. LaRoche
*Assistant Examiner*—Robert J. Pascal

[57] ABSTRACT

An easily removable high voltage ground stud insulative enclosure allows ready access to the ground stud bolt having one end directly attached to a switchgear terminal bus, with the other end adapted to receive a temporary ground connector. The removable part of the insulative enclosure consists of a thermoplastic insulative cylinder that is arranged over that part of the ground stud that is adapted for connection with the ground connector. The insulating properties of the thermoplastic material virtually eliminate arcing between the ground stud and the surrounding atmosphere when the switchgear is energized with high voltage.

8 Claims, 2 Drawing Sheets

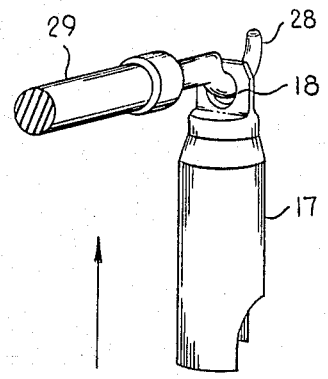
FIG 3
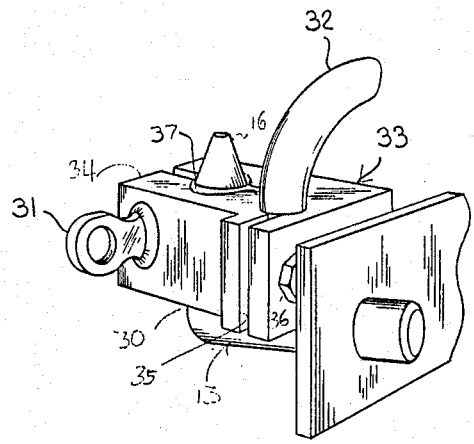

EASILY REMOVABLE HIGH VOLTAGE GROUND STUD INSULATOR

BACKGROUND OF THE INVENTION

High voltage switchgear, as defined herein, consists of a metallic enclosure containing a plurality of industrial-rated high voltage circuit breakers capable of interrupting currents at applied voltages in excess of 1,000 volts. When the switchgear is de-energized, for inspecting and repairing associated industrial equipment, is it required by state and national electric codes that the switchgear terminal bus be connected directly with ground. In the event that the switchgear is inadvertently energized while such inspection and repair is ongoing, this would prevent serious damage to the personnel, as well as to the associated equipment. To facilitate connecting the terminal bus to ground, a plurality of ground studs are attached to the terminal bus and are electrically insulated from the environment to prevent localized corona discharges from occurring.

Electrical connection with the ground studs is made by employing a "hotstick" which generally includes a long insulated handle with means for mechanically manipulatng an insulated hook-shaped end. The ground stud insulation generally includes an insulating cylindrical body terminating in an eyelet to facilitate capturing the insulating cylindrical body by the hotstick. The ground connector generally comprises a spring-loaded clamp at one end of a heavy gauge metal flexible conductor that is bolted to the system's ground terminal at an opposite end. U.S. Pat. No. 4,744,765, filed June 17, 1987, entitled "High Voltage Ground Stud" describes a ground stud insulator that is screwed onto the threaded end of the ground stud. This Application is incorporated herein for reference purposes and should be reviewed for a more detailed description of a high voltage switchgear and a ground stud. As described within the aforementioned U.S. Pat., an insulative cylinder, terminating in an eyelet, is threaded onto the ground stud in the same manner as for the high voltage studs. A separate insulative cap is threaded onto the threaded part of the ground stud that extends through the terminal bus to prevent localized corona from otherwise occurring with exposed metal parts at voltages in excess of 1000 volts. To access the ground stud, the hooked end of the hotstick is inserted through the eyelet at the end of the insulative enclosure to unscrew the insulative cylinder from the protected ground stud. Using the same hotstick, the ground conductor is attached to the exposed ground stud by means of a spring-loaded ground clamp Before energizing the high voltage switchgear, the procedure is reversed and the ground connector clamp is removed. The insulative cylinder is positioned over the exposed ground stud and is threaded onto the exposed ground stud threads. In some instances, it is important to rapidly expose and ground the ground stud without having to take the time required to unscrew the insulative cylinder from the ground stud to expose the threaded end of the ground stud. One purpose of the instant invention is to provide a ground stud insulator that readily facilitates access to the ground stud for connection and removal of a ground connection from the ground stud on a high voltage switchgear terminal bus without requiring the insulator to be unscrewed from the ground stud.

SUMMARY OF THE INVENTION

A three-piece insulative enclosure is used with an angled ground stud to protect the ground stud from atmospheric conditions and to prevent the occurrence of a localized corona discharge. One end of the angled ground stud is fastened to the switchgear terminal bus by means of a nut and an insulative cap is threaded onto the ground stud threads that extend beyond the end of the nut. The body portion of the angled ground stud is covered with an insulative sleeve to protect the angled ground stud in a similar manner. The opposite end of the angled ground stud is tapered to receive an insulated cylinder having an eyelet formed on a top surface thereof which is positioned over the tapered end of the angled ground stud to protect the tapered end in a similar manner. The insulated cylinder can be readily removed from the tapered end of the ground stud without having to unscrew the insulated cylinder from the ground stud.

BRIEF DESCRIPTION OF THE DRAWINGS

FIG. 3 is a side view of the angled ground stud and insulator of FIG. 2 with the insulated cylinder removed and with the angled ground stud attached to a ground connector.

DESCRIPTION OF THE PREFERRED EMBODIMENT

Figure 1:
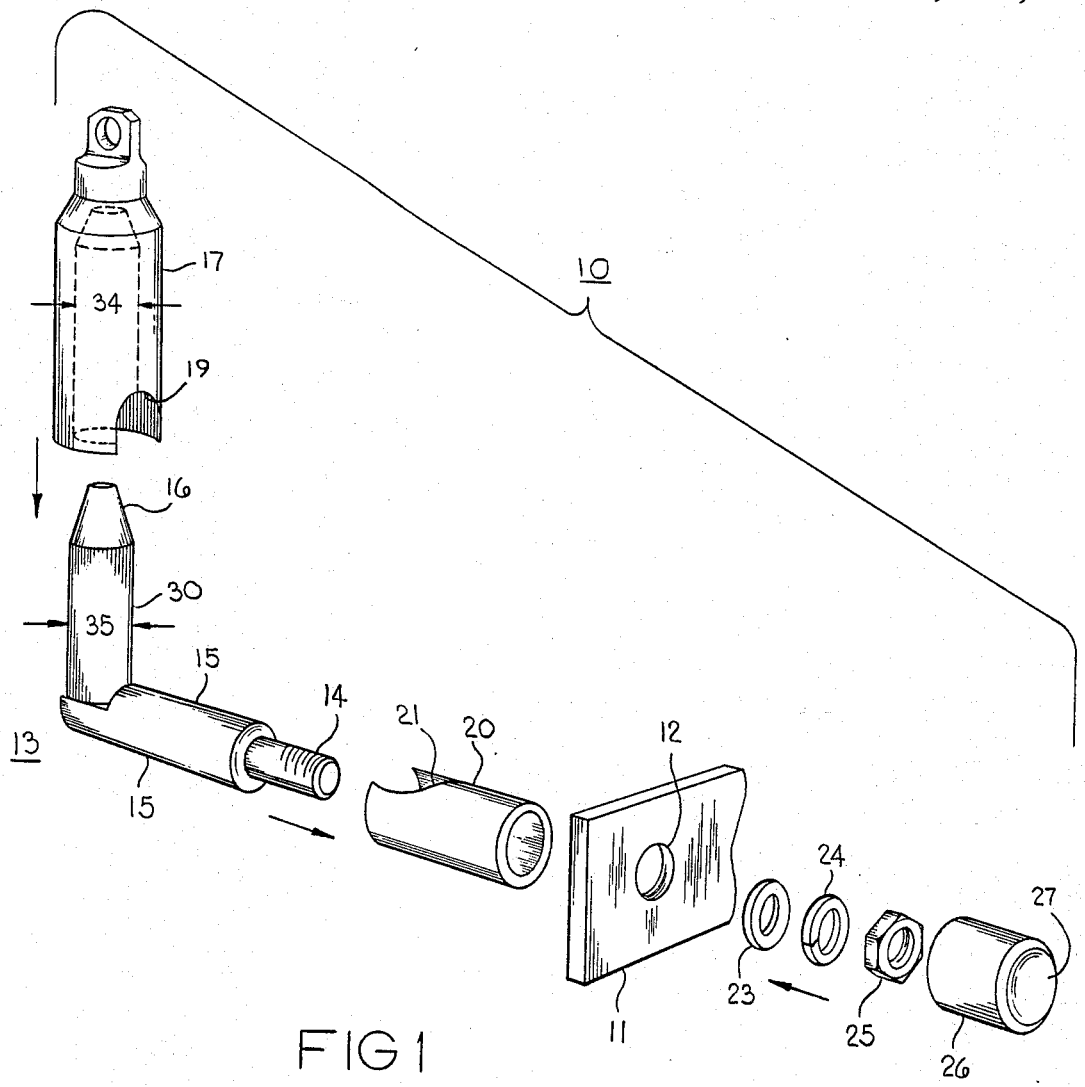
FIG. 1 is a top perspective view of an angled ground stud with the electric insulator of the invention shown in isometric projection.

The insulated ground lug assembly 10, is shown in FIG. 1 wherein a switchgear terminal bus 11 contains a thru-hole 12 for receiving the threaded end 14 of an angled ground stud 13. A hollow cylindrical sleeve 20 of an insulative plastic material such as Noryl, which is a trademrk of GE Company for a synthetic thermoplastic resin is slipped over the horizontal leg 15 of the angled ground lug 13 and is trapped there between when the flat washer 23, lock washer 24 are positioned over the threaded end 14 and the nut 25 is securely tightened thereto. To insulate the threaded end 14, an insulative plastic cylindrical cap 26 having a closed end 27 and fabricated from the same material as the hollow cylindrical sleeve 20 is threaded onto the threaded end 14. The tapered end 16 on the vertical leg 30 of the angled ground lug 15 facilitates the positioning of the hollow cylindrical cover 17 which also comprises the same insulative plastic material as the cylindrical sleeve 20 and cylindrical cap 26. A U-shaped slot 19 formed through one end of the cylindrical cover 17 overlaps a part of the cylindrical sleeve 20. A U-shaped slot 21 formed through one end of the cylindrical sleeve 20 partially encompasses the vertical leg 30 to insure that no metal parts of the angled ground stud 13 are exposed.

Figure 2:
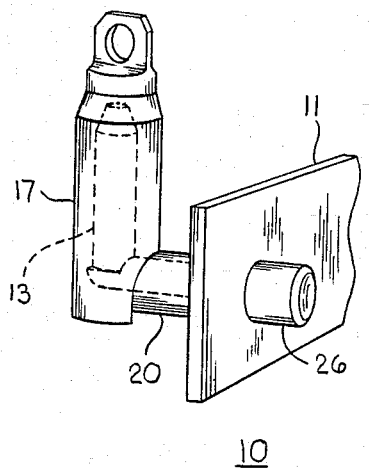
FIG. 2 is a side view of the angled ground stud and ground stud insulator of FIG. 1 assembled to a switchgear terminal bus.

The complete insulative ground stud assembly 10 is depicted in FIG. 2 wherein the cylindrical cap 26, cylindrical sleeve 20 and cylindrical cover 17 completely encompass and electrically insulate the angled ground stud 13 and hence prevent the formation of a corona discharge when the terminal bus 11 is at several thousands of volts potential. The clearance provided between the internal diameter 34 of the cylindrical cover 17 and the external diameter 35 of the vertical leg 30 as illustrated in FIG. 1, is selected to allow the cylindrical cover 17 to be easily lifted away from the vertical leg 30 as best seen by referring now to FIG. 3.

The cylindrical cover 17 is readily lifted away from the vertical leg 30 of the angled ground stud 13 by engaging the hook 28 at the end of a hotstick 29 with the eyelet 18 on the end of the cylindrical cover 17. A ground cable connector 33 is next placed over the tapered end 16 of the angled ground stud 13 and fastened to the vertical leg 30 by tightening the eye-bolt 31 on the side of the ground cable connector 33. The ground cable connector 33 consists of a bifurcated metal bar 34 to which the ground cable 32 is attached by means of slot 35 and bolt 36. The radial slot 37 receives the tapered end 16 of the angled ground stud 13 and is compressed therein by means of the threaded eyebolt 31. Ground connection is provided by means of a flexible ground cable 32, as indicated.

An angled ground stud has been described that is electrically insulated by means of a three-piece ground lug enclosure consisting of a cylindrical cover, an intermediate cylindrical sleeve and a cylindrical cap. The cylindrical sleeve of the enclosure slides over the vertical leg of the ground stud and is easily removed therefrom by means of a hotstick without having to be unscrewed.

Having thus described my invention, what I claim as new and desire to secure by Letters Patent is:

1. An insulated ground stud for electrical equipment comprising:

an angled metal bar having a threaded end and a tapered end;

a hollow cylindrical insulative cover arranged over said tapered end;

a hollow cylindrical insulative cap attached to said threaded end; and a hollow cylindrical insulative sleeve arranged on said metal bar intermediate said tapered end and said threaded end to electrically insulate said metal bar and to prevent said metal bar from forming a corona discharge when said threaded end is attached to a voltage source.

2. The ground stud of claim 1 wherein said insulative cover includes an eyelet formed on an outer surface at one end and a transverse slot formed at an opposite end.

3. The ground stud of claim 1 wherein said insulative sleeve includes a transverse slot formed at one end.

4. The ground stud of claim 1 wherein said metal bar comprises a first and a second leg arranged at an angle to each other.

5. The ground stud of claim 4 wherein said insulative sleeve partially encompasses a part of said first leg.

6. The ground stud of claim 2 wherein said insulative cover partially encompasses said insulative sleeve.

7. The ground stud of claim 1 wherein said insulative cover includes an internal diameter larger than an exterior diameter of said insulative sleeve.

8. The ground stud of claim 1 wherein said insulative cover, cap and sleeve each comprise a thermoplastic resin.

* * * * *